United States Patent [19]

Holmen et al.

[11] Patent Number: 5,071,534

[45] Date of Patent: Dec. 10, 1991

[54] ALUMINUM ELECTROLYSIS CELL WITH CONTINUOUS ANODE

[75] Inventors: Hans K. Holmen, Vöyenenga; Tormod Naterstad, Asker; Jan Hurlen, Oslo; Sigmund Gjörven, Årdalstangen, all of Norway

[73] Assignee: Norsk Hydro a.s., Oslo, Norway

[21] Appl. No.: 468,868

[22] Filed: Jan. 23, 1990

[30] Foreign Application Priority Data

Jan. 23, 1989 [NO] Norway ..... 890289

[51] Int. Cl.[5] ..... C25C 3/08

[52] U.S. Cl. ..... 204/245; 204/243 R; 204/67

[58] Field of Search ..... 204/67, 243 R, 245, 204/279, 280; 373/88, 92

[56] References Cited

U.S. PATENT DOCUMENTS 3,009,870 11/1961 Helling et al. ..... 204/243 R

FOREIGN PATENT DOCUMENTS 73535 5/1948 Norway .
98126 6/1961 Norway .

*Primary Examiner*—John Niebling
*Assistant Examiner*—Kathryn Gorgos
*Attorney, Agent, or Firm*—Wenderoth, Lind & Ponack

[57] ABSTRACT

An aluminum electrolysis cell comprises a cathode and a continuous anode disposed above the cathode. The anode is composed of carbon elements which are glued or in some other way connected to one another. Onto the anode, there are added new elements to replace carbon material consumed during the electrolysis process. The anode is divided into sections defined by easily detachable holders or cassettes which are disposed close to one another in a row longitudinally of the cell. The cassettes are each provided at their upper ends with projections designed to be detachably connected to bearer walls or structures along the long sides of the cell.

19 Claims, 7 Drawing Sheets

ALUMINUM ELECTROLYSIS CELL WITH CONTINUOUS ANODE

BACKGROUND OF THE INVENTION

The present invention relates to electrolysis cells for producing aluminum comprising a cathode and an anode of the continuous type. The anode is composed of blocks of carbon glued or mechanically attached to one another, and new blocks of carbon are attached to the anode to replace carbon material consumed during the electrolysis process.

Aluminum is nowadays produced in electrolysis cells based on two different principles, namely cells provided with self-baking anodes, so called Soederberg anodes, and cells equipped with prebaked carbon anodes which have to be exchanged with new anodes due to their consumption during the electrolysis process.

Electrolysis cells with anodes of the prebaked type have the advantage that the voltage drop is less than for the Soederberg type. This mainly has to do with the fact that the specific electrical resistance in prebaked anodes is lower than the resistance in the coke mass of the Soederberg anodes. In addition, the drop in voltage between the current conductors and the carbon material is lower for the prebaked anodes than for the Soederberg anodes, as the current conductors for the prebaked anodes are connected to the carbon blocks beforehand and can be firmly connected by means of gluing, screwing, casting or the like, whereas the current conductors for the Soederberg anodes are placed in position in the carbonatious anode mass during the electrolysis process in such a way that when they have reached their lowermost position they can be pulled up to be repositioned, such that the resulting connection is relatively loose.

On the other hand, the prebaked anodes of the discontinuous type are encumbered with several disadvantages. As they have to be replaced by new ones before they are completely used, there is an anode rest loss of about 15-25% of the total anode consumption. Further, the exchange and maintenance work is extensive and results in great expense.

Due to the disadvantage of the traditional electrolysis cells, the aluminum production companies have been engaged in research and development to provide electrolysis cells with prebaked anodes of the continuous type as mentioned initially. Norwegian Patent No. 98126 discloses a cell for producing aluminum in which is used a continuous prebaked anode composed of blocks of carbon being attached to one another by means of gluing. Except that the anode is composed of glued blocks of carbon, the solution according to this reference is based on the Soederberg principle as the anode is disposed in a vertically sliding relation with a steel jacket, and the electric current is conducted via contact bolts provided in holes in the top side of the anode. When attaching new carbon blocks to the anode, the bolts have to be pulled out. This is impractical and time consuming and results in high operation costs. This solution has, therefore, not found any practical application.

In Norwegian Patent No. 98126, there is further shown a cell for producing aluminum where two electrodes are arranged in side by side relation in steel jackets. The electrodes are composed of blocks of carbon onto which can be joined new blocks of carbon as the anodes are used. The feeding of the anodes is accomplished by means of jacks provided on top of the steel jackets. Further, for the supply of electric current to the electrodes and to provide the necessary friction to hold the electrodes, the lower ends of the steel jackets are provided with pressure devices in the form of weight arms, each acting on an exchangeable sliding contact which is influenced by a spring provided with an individual screw adjusting means.

A disadvantage with the above solution is that the pressure devices, which are complicated in their structural design, comprising screws and moveable parts, are disposed slightly above the electrolytic bath and will, therefore, very quickly become damaged by the heat and harmful gases from the bath. It is further a disadvantage that the pressure devices are large in size, as this reduces the effective anode area and makes it more difficult to get access to the electrolytic bath, for instance, in connection with taping of metal, crust breaking, etc.

Since only two electrodes having large carbon anodes which are cumbersome to handle are used, the maintenance of such cells is difficult. Furthermore, the large carbon blocks for which their is a relatively long distance between current connectors, provide an ineffective current supply and uneven current distribution in the anode.

Due to the above disadvantages, the solution disclosed in Norwegian Patent No. 73535 has not found any practical use.

SUMMARY OF THE INVENTION

It is an object of the present invention to provide an electrolysis cell for producing aluminum based on the continuous anode principle which is not encumbered with the above disadvantages, i.e. which is structurally simple and thus inexpensive to build, and which at the same time is reliable and uncomplicated to maintain.

According to the invention, this is achieved by means of an electrolysis cell of the kind mentioned initially and which is characterized in that the anode is divided into sections in the form of easily removable cassettes or holders which are placed in close relation to one another such that they are positioned side by side in a row longitudinally of the cell. At the upper end of each of the cassettes, there is provided a projection adapted to be disconnectable to bearer walls or constructions located on the long sides of the cell.

BRIEF DESCRIPTION OF THE DRAWINGS

The invention will now be further described by way of examples and with reference to the drawings in which.

DETAILED DESCRIPTION OF THE INVENTION

Figure 1:
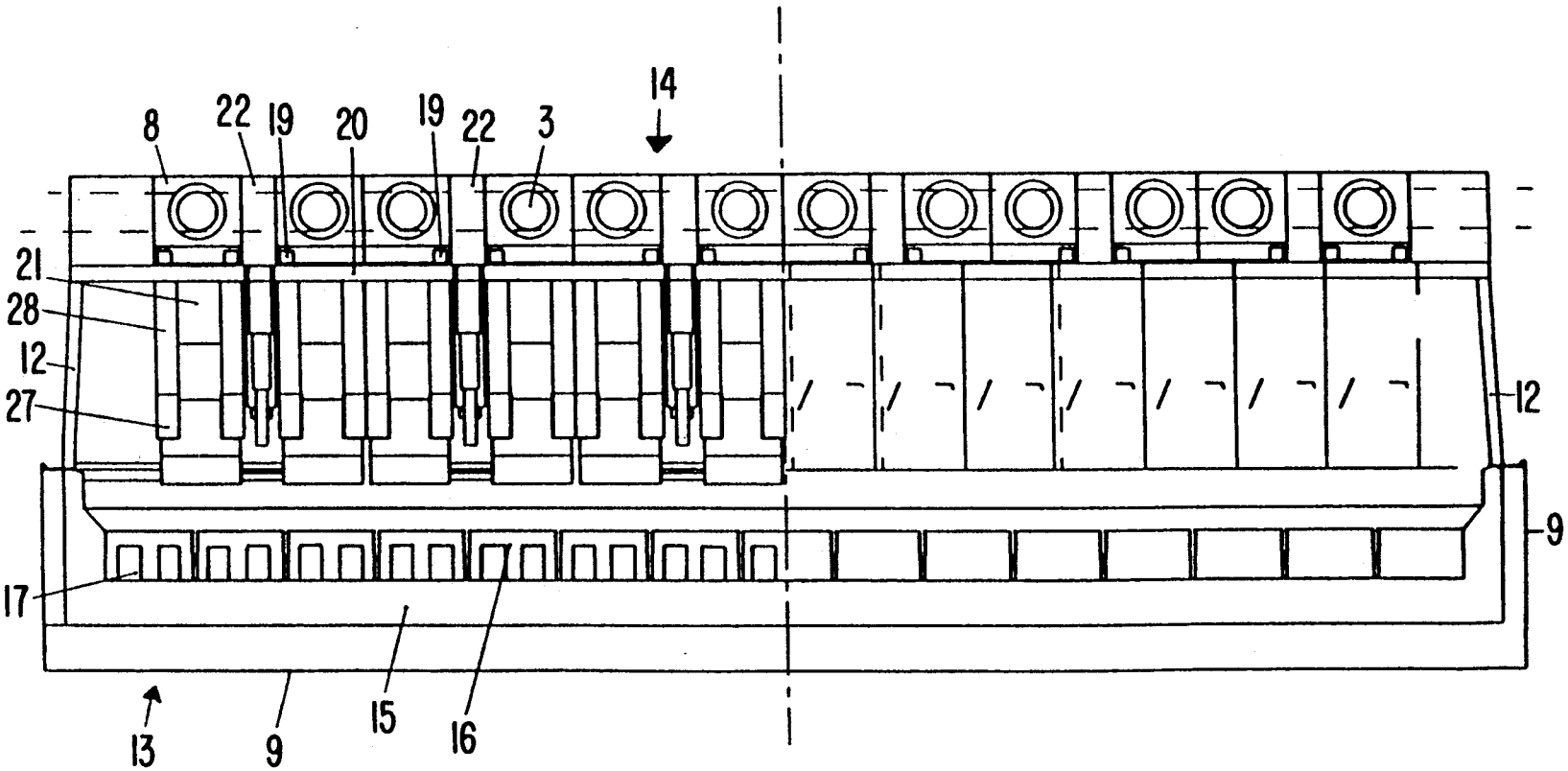
FIG. 1 shows a side view, partly in section, of a cell according to the invention.
Figure 2:
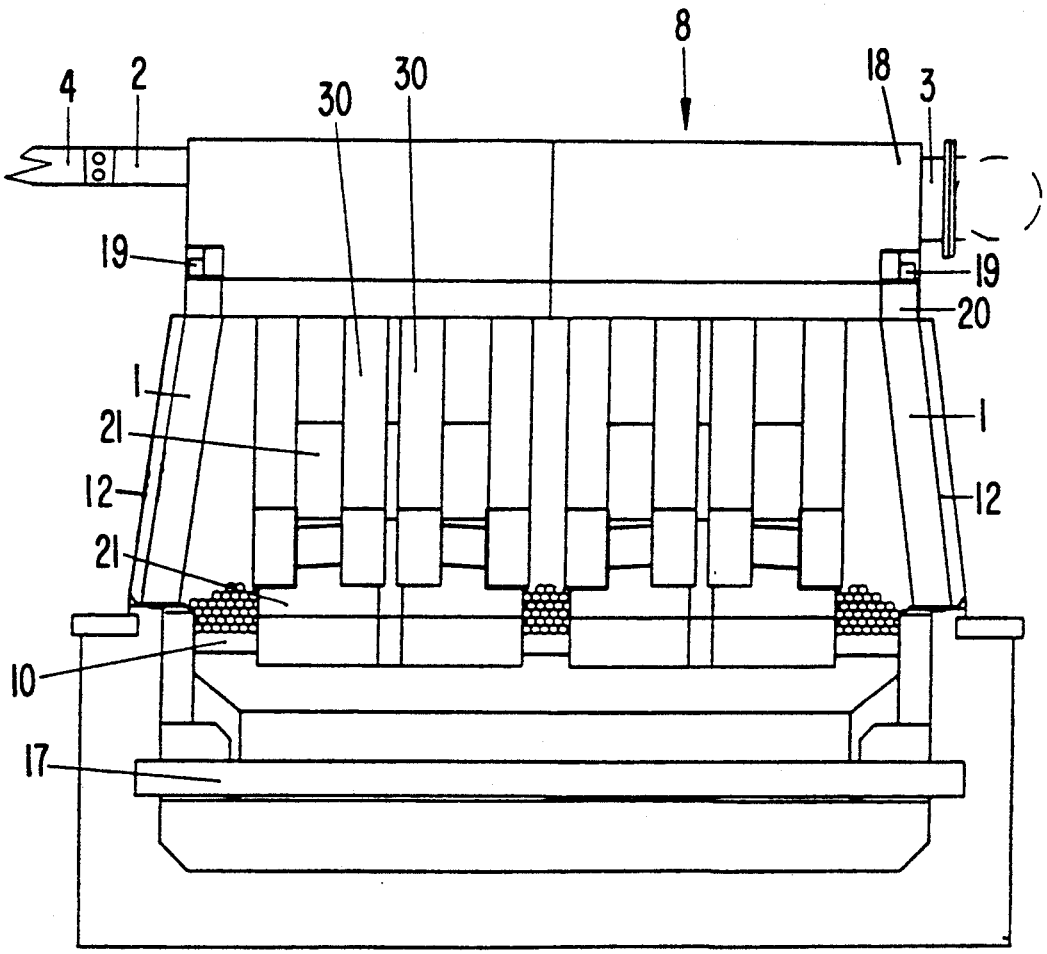
FIG. 2 shows the cell of FIG. 1 in cross section.

In FIGS. 1 and 2, reference numbers 13 and 14 refer to the cell cathode and anode, respectively. The cathode 13 may be of a per se known, traditional design comprising a steel shell 9, a refractory lining 15, an inner carbon layer 16 with cathode busbars 17 and cathode collectors (not shown).

The anode is made up of easily exchangeable cassettes or holders 8 which are provided for continuous feeding of segments or blocks of carbon 21. Between the cassettes 8, there are disposed additional cassettes 22 containing equipment for the supply of additive materials such as aluminum oxide to the electrolytic bath. The cassettes 8, 22 are provided with projections 18 which are supported on vertically movable bars 20. The cassettes are placed in close relation relative to one another so that they form an upper closure for the cell. Designing the anode in the manner described above is important because it provides the advantage that the cassettes can easily be replaced by new ones if necessary.

As previously mentioned the cassettes are supported by movable bars 20. These bars are provided with jacks 19, which are preferably hydraulic or mechanical, so as to make it possible to lower, lift or tilt the anode (e.g. the cassettes), so as to overcome problems such as to improve electrical connections to the anode. The jacks 19 are disposed on pillars 1 which rest on the cathode or on the cell foundation to form a support structure, such that the whole anode arrangement is carried by these pillars. An outwardly/upwardly swingable or easily detachable cover 12 is provided along each of the short ends and sides of the cell. This cover which is in the form of plates or the like provides a tight closure for the cell when the plates (of the cover) are in a closed position, and gives easy access to the cell when they are in an open position.

Since the cassettes provide an upper closure for the cell and the ends and sides of the cell are covered with plates 12, the spacing above the cell is completely enclosed. This enables the gases produced during the electrolysis process to be evacuated through an evacuation duct 3.

In a preferred embodiment of the invention, the cassettes are provided with cooling conduits to reduce the temperature in the cassette walls and clamping devices 27 which are designed to hold the carbon 21. Gas ducts or pipes, for cooling fluid, are connected at one end to a gas supply and at the other end to a gas return pipe (not shown). These gas ducts are located just below the cassettes at the ends thereof.

Figure 3:
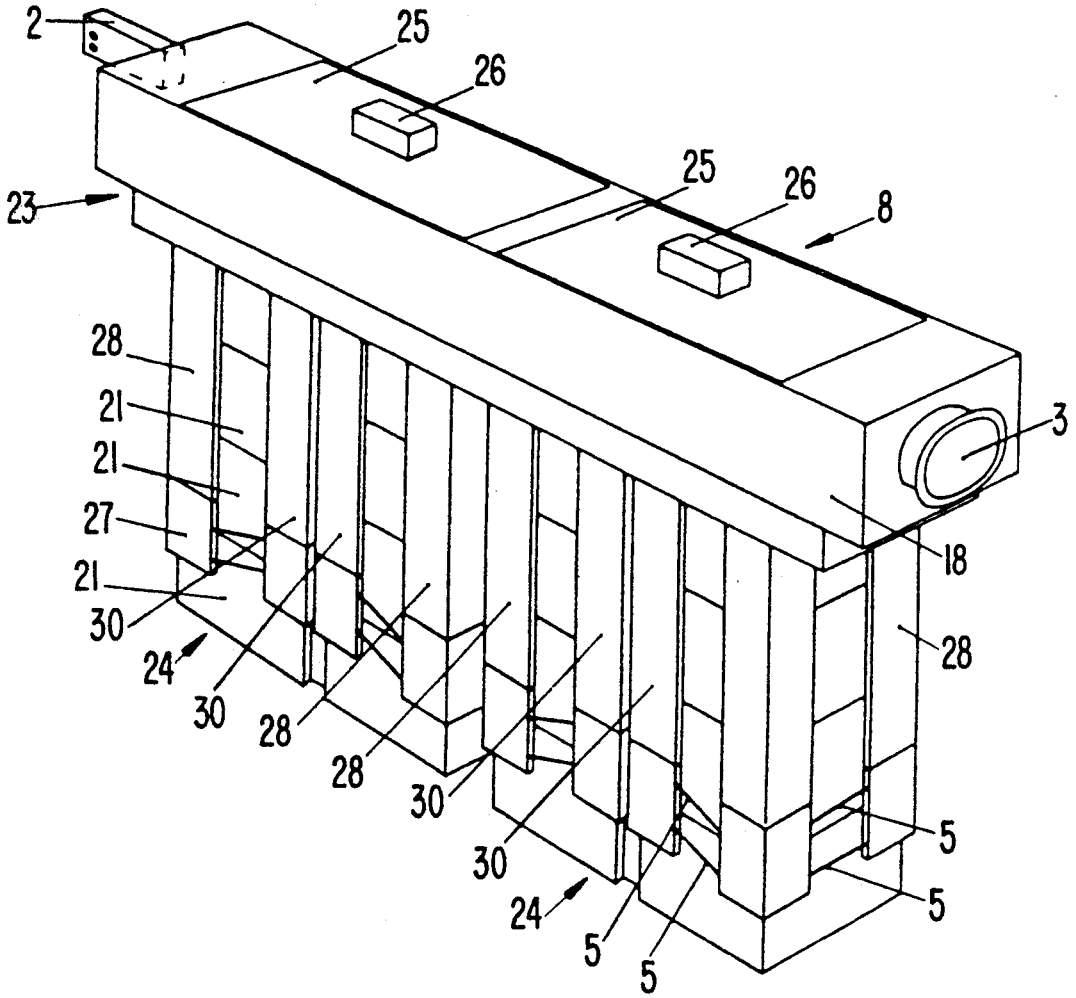
FIG. 3 shows in larger scale a perspective view of an anode cassette with a clamping device according to the invention.

With regard to the cassettes 8, these are wholly or partly made of electrically conductive materials and are electrically connected to anode busbars via a connection 2 and flexible cable 4 or the like. The structural design of the cassettes is further shown in FIGS. 3-5. As can be seen in FIG. 3, each of the cassettes consists of an upper part 23 which has connected thereto two guides 24 for anode carbon blocks or segment 21. The carbon blocks 21 are attached to one another by means of gluing or the like, and can, as they are gradually consumed from below, be "extended" at the top by gluing a new carbon block thereto. To reduce the heat loss through the cassettes, insulation blocks 25 can be provided on top of the carbon blocks for each of the guides 24. Such insulation blocks are most important when the cassettes are provided with cooling equipment. It should be stressed, however, that the cells according to the invention can be used with or without cooling equipment.

The feeding of the anode carbon down through the guides 24 is accomplished individually by means of removable jacks (shown schematically at 26) which are governed by means of a governing unit (not shown). The jacks can be of the mechanical or hydraulic type, but the construction thereof will not be further described.

Figure 4:
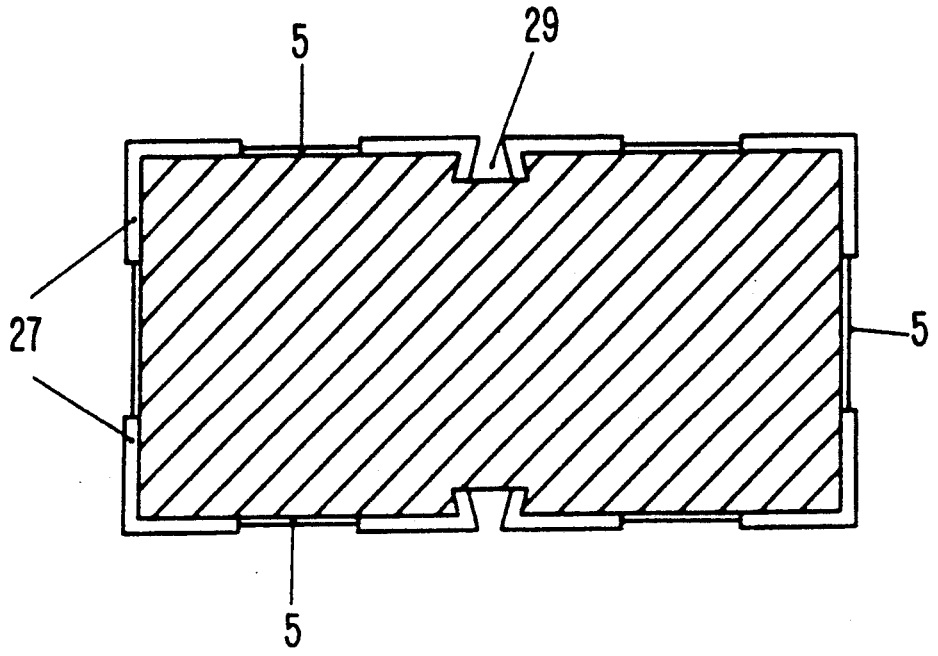
FIG. 4 shows a horizontal section, taken in the area of the clamping device, of the anode cassette shown in FIG. 9.

The lower part of the guides 24 comprise a holder arrangement in the form of a clamping device 27 which is fastened to the upper part of the guides by means of stays/conductors 28, 30 (see also FIG. 4 which shows a horizontal section of a cassette guide 24 in the area of the clamping device). The purpose of the holder arrangement is to hold the "stack" of carbon blocks by means of frictional force, and at the same time conduct electric current to the anode carbon. This holder arrangement (which will be more fully described below) provides a technical solution which results in a short current path between the electrical contacts of the clamping device and the electrolytic bath, which can withstand the corrosive environment close to the electrolytic bath, and which has a reduced structural width (i.e. it is compact in design). This last mentioned advantage is important due to the short distance between the cassettes.

The clamping devices are connected with one another along the circumferential direction of the cassettes by means of cross stays 5 and are pressed against the corners and into swallow tail grooves 29 by shortening the effective length of the stays 5 by, for example, bending them. The reason for using swallow tail grooves 29 is that carbon blocks having relatively elongated rectangular cross sections are used, thus making it necessary to apply extra current contacts to obtain the best possible current distribution in the anode. With regard to providing a short current path, it would be more advantageous to use carbon blocks with quadratic cross sections, for which it would only be necessary to use clamping devices at the corners of the anode. The stays 5 are so designed that they can be subjected to bending. By pulling/lifting or pushing/lowering the stays 30, the distance between the clamping devices can be shortened and the pressure against the anode can be increased. Under normal operating conditions, it is sufficient to hold the stays tight against the carbon blocks by means of a preset spring (not shown).

The presetting of the spring can be governed so that small irregularities in the dimensions of the anode can be accommodated without changing the holding forces beyond an acceptable tolerance.

The holding force and pressure between the clamping device and the anode can be selected according to the requirements of the specific operating conditions.

Figure 5:
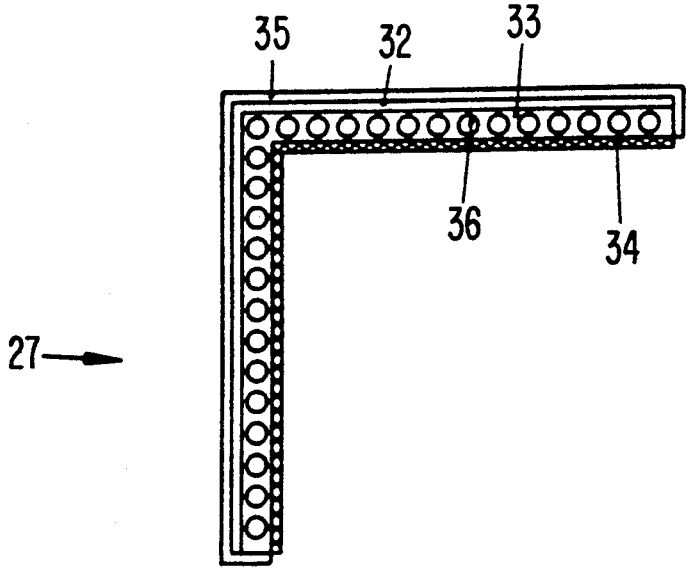
FIG. 5 shows a horizontal section of the clamping device.

The design of the clamping device is shown in FIG. 5. It consists of a structural part 32, a current conducting part 33, a wear resistant layer 34 and external insulation 35.

If the clamping devices and the structural elements which interconnect these devices are cooled down, less expensive materials can be used and improved results may be achieved in the form of increased contact pressure and reduced electrical resistance between the clamping devices and anode.

FIG. 5 shows bores or conduits 36 for the circulation of cooling fluid through the clamping devices. Such bores or conduits are also provided in the stays 28 to provide cooling thereof. It should be added in this connection that the energy being extracted from the cooling fluid can be used for energy saving purposes, as set forth in Norwegian Patent No. 158511 belonging to one of the inventors of the present invention.

Figure 6:
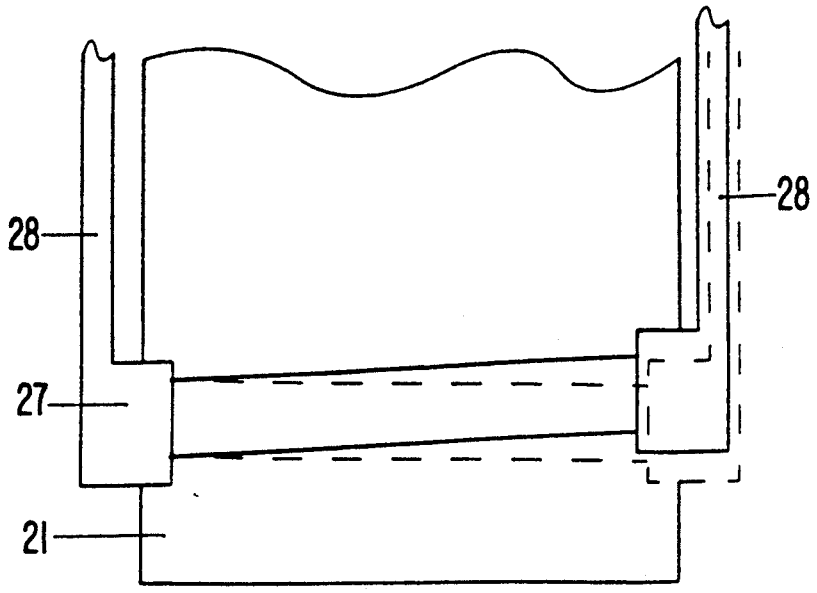
FIG. 6 shows an alternative arrangement for regulating the contact force of the clamping device.
Figure 7:
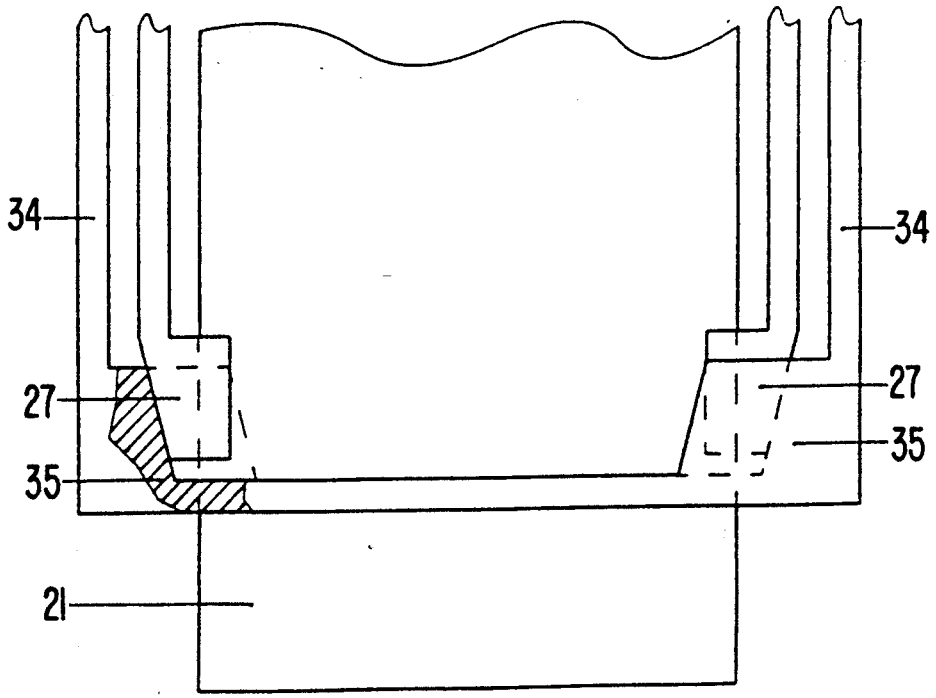
FIG. 7 shows another alternative arrangement for regulating the contact force of the clamping device.

In the previously mentioned example, the contact force between the clamping devices and the anode carbon blocks is adjusted by pulling or pushing the stays 30. FIG. 6 shows another example in which the clamping force is adjusted by moving the stays 28 up or down relative to one another. Further, FIG. 7 reveals another example where the clamping devices are forced against the anode carbon blocks by means of some kind of wedge arrangement. For example, a frame 34 can be provided on the outside of the stays 28 and can be lifted or lowered. At the lower parts of its corners, the frame 34 is provided with inclined guides 35 which cooperate with complementary guides on the clamping devices 27.

Figure 8:
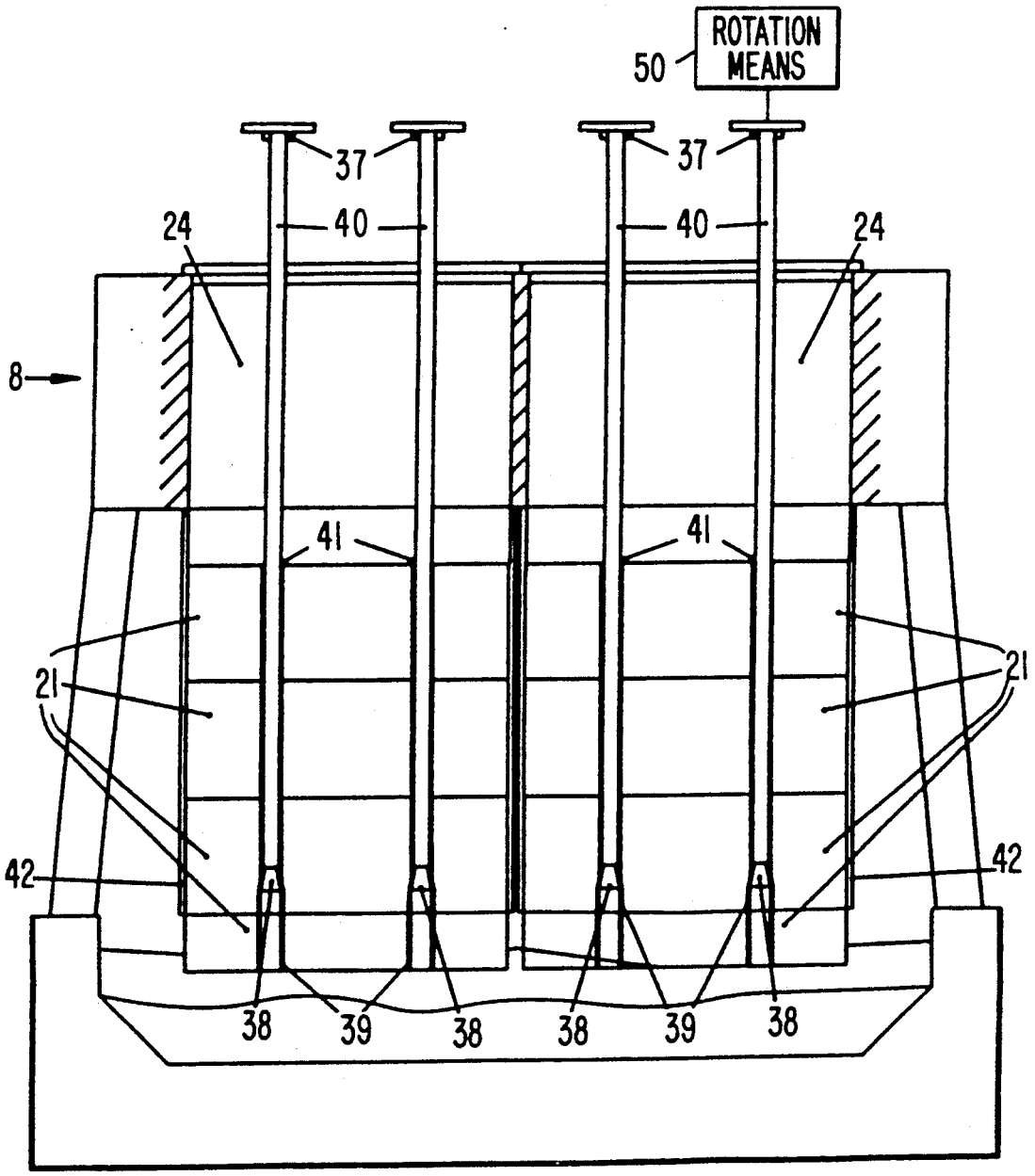
FIG. 8 shows a cross section view of a cell with an alternative holding and feeding arrangement.

FIG. 8 shows a cross section of a cell provided with an anode cassette 8 which has an alternatively designed holding and feeding arrangement. This example includes a cassette with two guides for the anode carbon blocks 21. Instead of using clamping devices as explained above, each of the anode carbon blocks 21 has two vertical bores 41 formed therethrough. Conical spindles 40 having threads 38 at their lower ends are provided and extend through the bores 41 which have complementary threads 39. The spindle 40 are provided with thrust bearings 37 at their upper ends and can be rotated by means of a gear and driving arrangement (shown schematically at 50). The anode carbon blocks 21 are held in position by means of the spindles, and can be elevated or lowered by rotating the spindles. Electric current can be supplied wholly or partly through the spindles or through guiding jackets 42.

Figure 9:
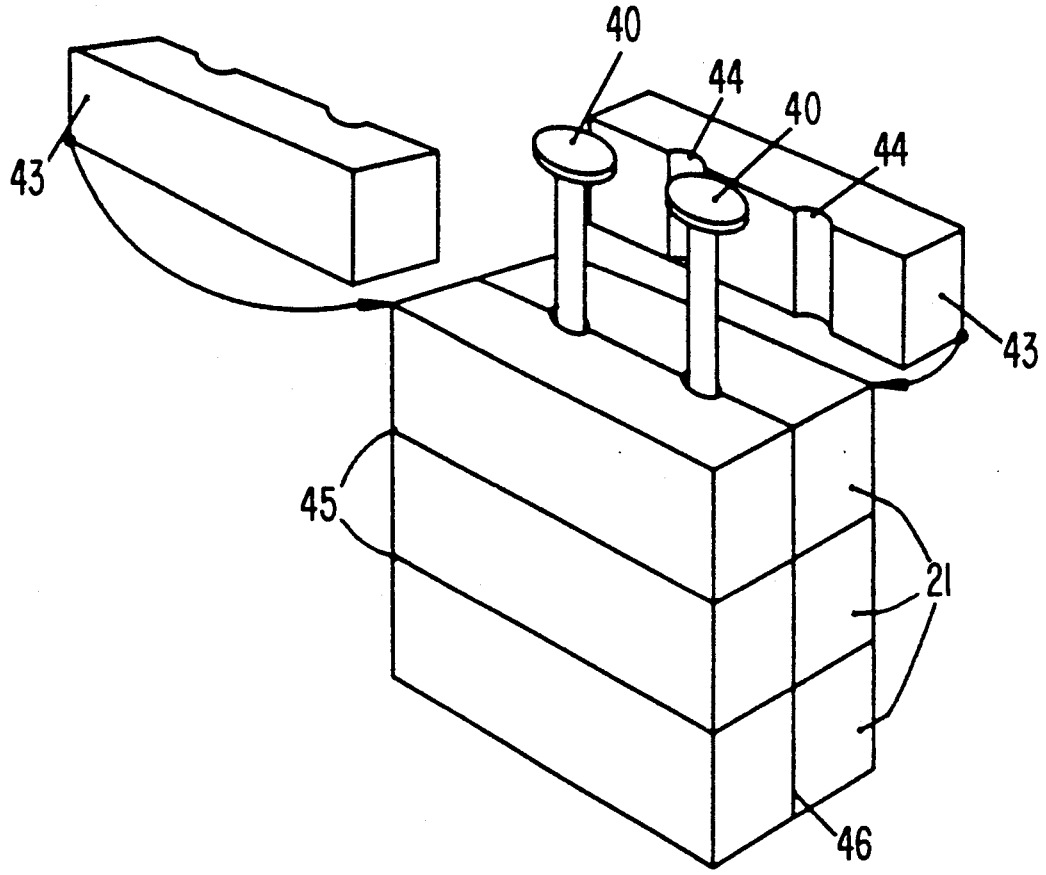
FIG. 9 shows schematically a preferred method of attaching a carbon block to the anode of the arrangement shown in FIG. 8.

A preferred method of adding new carbon blocks to the top of the anode as they are gradually consumed is illustrated schematically in FIG. 9. As can be seen, each of the carbon blocks or elements consist of two halves 43, each of which is provided with two parallel, semi-circular grooves 44.

The halves 43 should be placed on top of the "stack" of carbon blocks 21 (the cassette guides are not shown), and the semi-circular grooves form the "bores" 41 after a gluing operation has taken place. The reference number 45 indicates the glue layers between the carbon blocks 21. Alternatively, glue may also be used between the halves 43 (at 46).

The guides 24 prevent the two halves 43 from being split after the gluing has taken place. Since just after the two halves have been added to the top of the stack, the glue will not have hardened, the clearance between the guides 24, and the carbon blocks 21 should be sufficient to let the carbon blocks slide downwards by their own weight. At the lower ends of the guides 42 just opposite the threads 38 of the spindles, the clearance should be reduced. Alternatively, the clearance (tolerance) could be so narrow that all or part of the electric current is conducted to the carbon in this area.

With regard to the adding of new carbon blocks to the anode, it should be mentioned that the invention is not restricted to the example described above using two carbon block halves. The carbon can be made in one piece and have bores formed therethrough, such that the carbon blocks can be placed over the top of the spindles. Further, the carbon blocks do not need to be provided with two bores and two corresponding spindles, but can have one or more holes and a corresponding amount of spindles. Or, they can be provided with grooves at their corners and be provided with spindles disposed between the anode carbon blocks and the walls/corners of the anode guide.

In the figures and description, there are disclosed examples where carbon blocks of rectangular or quadratic shape are used. Of course, the invention is not restricted to such shapes, but can be varied within the limits of the claims. Thus, the carbon bodies may have a circular cross section or other shape. Furthermore, the cassettes need not have two guides, but can have one or more than two such guides, and the carbon blocks may be of the prebaked type as well as a "green carbon" type.

We claim:

1. An aluminum electrolysis cell for use in an electrolysis process, comprising:

a cathode;

an anode mounted above said cathode, said anode comprising a plurality of horizontally aligned carbon element cassettes mounted in side-by-side relation to one another, each of said plurality of carbon element cassettes comprising means for holding a stack of vertically aligned carbon elements such that carbon elements can be added to the stack as other carbon elements are consumed during the electrolysis process;

cassette connecting means for detachably connecting said plurality of carbon element cassettes in a horizontal row; and means for electrically connecting said cathode to said anode.

2. An aluminum electrolysis cell as recited in claim 1, further comprising carbon element connecting means for mutually connecting adjacent carbon elements of a single stack of carbon elements.

3. An aluminum electrolysis cell as recited in claim 2, wherein said carbon element connecting means comprises glue.

4. An aluminum electrolysis cell as recited in claim 1, further comprising a support structure; and structure connecting means for detachably connecting said carbon element cassettes to said bearer structure.

5. An aluminum electrolysis cell as recited in claim 4, further comprising vertically moveable bars supported by said support structure; and wherein said bearer structure connecting means comprises projections supported by said vertically moveable bars.

6. An aluminum electrolysis cell as recited in claim 5, further comprising jacking means, connected to said vertically moveable bars, for jacking said bars relative to said support structure.

7. An aluminum electrolysis cell as recited in claim 6, wherein said jacking means comprises a jack operatively connected to each end of each of said vertically moveable bars.

8. An aluminum electrolysis cell as recited in claim 1, wherein each cassette comprises a guide means for guiding vertical movement of a stack of carbon elements.

9. An aluminum electrolysis cell as recited in claim 8, wherein each said guide means comprises a jacket at an upper portion thereof for encompassing carbon elements, and a lower portion which includes a means for frictionally holding the stack of carbon elements and a means for conducting electrical current to the carbon elements.

10. An aluminum electrolysis cell as recited in claim 9, wherein said means for frictionally holding the stack of carbon elements comprises a plurality of clamping devices for acting respectively against corners of the carbon elements, said clamping devices being mutually interconnected by cross stays, said cross stays being held in position by vertical stays.

11. An aluminum electrolysis cell as recited in claim 10, wherein said cross stays are bendable to allow for adjustment of the force with which said clamping devices act against the corners of the carbon elements.

12. An aluminum electrolysis cell as recited in claim 10, wherein said vertical stays are vertically moveable relative to one another to allow for adjustment of the force with which said clamping devices act against the corners of the carbon elements.

13. An aluminum electrolysis cell as recited in claim 10, wherein said means for frictionally holding the stack of carbon elements comprises spring means for biasing said clamping devices against the carbon elements.

14. An aluminum electrolysis cell as recited in claim 9, wherein said means for frictionally holding the stack of carbon elements comprises means for acting against the carbon elements with an adjustable force.

15. An aluminum electrolysis cell as recited in claim 9, wherein said means for frictionally holding the stack of carbon elements comprises a plurality of clamping devices, each of which includes an inclined guide, and a vertically adjustable frame which includes inclined guides complementary to and in sliding contact with said inclined guides of said clamping devices, respectively, such that as said vertically adjustable frame is adjusted vertically, the force with which said clamping devices act against the carbon elements is correspondingly adjusted.

16. An aluminum electrolysis cell as recited in claim 8, wherein each of the carbon elements are formed with vertical holes therein which register with one another when the carbon elements are stacked; and each said guide means comprises a jacket at an upper portion thereof for encompassing carbon elements, at least one spindle adapted to extend through said vertical holes in the carbon elements, and means for vertically adjusting the carbon elements relative to said at least one spindle.

17. An aluminum electrolysis cell as recited in claim 16, wherein said means for vertically adjusting the carbon elements comprises complementary threads in the vertical holes of the carbon elements and on a lower portion of said at least one spindle, and means for rotating said at least one spindle.

18. An aluminum electrolysis cell as recited in claim 17, wherein each of the carbon elements includes two horizontally separable parts and the holes in the carbon elements are formed by semi-circular grooves in each of the horizontally separable parts.

19. An aluminum electrolysis cell as recited in claim 1, wherein each cassette comprises a guide means for guiding vertical movement of two stacks of carbon elements.

* * * * *